United States Patent [19]

Moroff et al.

[11] 4,324,832

[45] Apr. 13, 1982

[54] METHOD OF IMPREGNATING WEB STRUCTURES WITH A SYNTHETIC RESIN

[75] Inventors: Helmut Moroff, Muehltal-Trautheim; Hanns Boessler, Darmstadt; Hans Hauser, Muehltal; Gerhard Ladisich, Gernsheim, all of Fed. Rep. of Germany

[73] Assignee: Röhm GmbH, Darmstadt, Fed. Rep. of Germany

[21] Appl. No.: 113,219

[22] Filed: Jan. 18, 1980

[30] Foreign Application Priority Data

Jan. 27, 1979 [DE] Fed. Rep. of Germany ..... 2903172

[51] Int. Cl.[3] ..... B44D 1/44; B05D 3/02; B05D 3/12; B32B 27/00

[52] U.S. Cl. ..... 428/289; 427/366; 427/385.5; 427/391; 427/430.1; 427/439; 428/290; 428/514; 428/530

[58] Field of Search ..... 427/366, 391, 439, 385.5, 427/430.1; 428/289, 290, 514, 530

[56] References Cited

U.S. PATENT DOCUMENTS

| | | | |
|---|---|---|---|
| 3,813,262 | 5/1974 | Shelton et al. | 427/439 X |
| 3,853,594 | 12/1974 | Moroff et al. | 427/366 |

FOREIGN PATENT DOCUMENTS

| | | |
|---|---|---|
| 1619228 | 4/1967 | Fed. Rep. of Germany . |
| 1771903 | 7/1968 | Fed. Rep. of Germany . |
| 1804159 | 10/1968 | Fed. Rep. of Germany . |
| 2135072 | 7/1971 | Fed. Rep. of Germany . |
| 2550980 | 11/1975 | Fed. Rep. of Germany . |
| 1275165 | 9/1901 | France . |
| 998188 | 7/1965 | United Kingdom . |

*Primary Examiner*—Michael R. Lusignan
*Attorney, Agent, or Firm*—Curtis, Morris & Safford

[57] ABSTRACT

What is disclosed is a method for making a synthetic veneer, which method comprises impregnating a fibrous web structure with an aqueous dispersion of a finely divided synthetic resin, said dispersion further containing a water-soluble aminoplast resin dissolved therein, and then drying the impregnated web structure by heating it, said synthetic resin being thermoplastically deformable and in a non-crosslinked condition at the beginning of the drying step, but comprising a plurality of groups capable of external crosslinking and which do crosslink during the drying step.

12 Claims, No Drawings

METHOD OF IMPREGNATING WEB STRUCTURES WITH A SYNTHETIC RESIN

The present invention relates to a method for strengthening web structures by impregnating them with a dispersion of a heat-curable externally cross-linking synthetic resin and to the strengthened web structures obtained by such impregnation followed by heating.

By the impregnation of paper, non-woven fabrics, and other fiber-containing surfaces (textiles) with thermoplastic synthetic resins, planar web structures having improved surfaces and improved mechanical properties can be prepared. Resin-impregnated papers (decorative coatings or veneers) particularly are used to a considerable degree for the finishing of wood and other suitable materials.

Certain prior art has recommended a method for the preparation of highly-glossy surfaces in such decorative papers by saturating or coating a raw decorative paper with a filler-free mixture of a thermoplastic dispersion and a self-cross linking aqueous dispersion comprising an acrylate resin, subsequently drying, and then calendering with a high-gloss polished roll at a temperature between 120° C. and 180° C.

According to the teachings of still other prior art, linear polymers having repeating N-methylolamide units and groups capable of reaction therewith are used for the impregnation or coating of non-woven fabrics, particularly in the form of acqueous dispersions in admixture with heat-hardening aminoplast resins.

Still other prior art has as its object a method for the continuous preparation of woven or non-woven fabrics which have been impregnated with polymers and heat-hardened under pressure. In this method, the substrate is continuously impregnated with a mixture of acrylic ester polymers or copolymers containing internal cross-linking groups (self-cross-linking groups) and heat-hardenable polymers, wherein the amount of heat-hardenable polymer in the impregnating agent is between 5 and 50 percent by weight. The impregnated woven or non-woven fabric is then subsequently continuously hardened in a heated calender. In order to be suitable for use as decorative coatings, impregnated webs of the above-mentioned kind should if possible have a closed surface, a high resistance to tearing, sufficient stability of form, good resistance particularly toward thermal stresses and against solvents, and a good ability to adhere.

The methods and products of the state of the art are not completely satisfactory. For example, the question of the stability of the impregnating bath takes on a practical significance which should not be underestimated. For example, the tendency of precondensates (urea- and/or melamine-resins) to a premature condensation must be watched for. Naturally, this condition plays a special role at elevated temperatures, that is in hot weather and in corresponding climatic zones. In contrast, impregnating baths according to the present invention are distinguished by a storage stability of several days, even when high temperatures prevail in the work room.

It has been found that the particle size of the thermoplastic polymer can have a relatively large influence on the quality of the finished webs.

It has now been found that valuable strengthened films can be obtained if a planar web structure such as a raw paper or non-woven fabric is saturated with a mixture which, on the one hand, contains a commercially-available water-soluble aminoplast resin and, on the other hand, contains an aqueous synthetic resin dispersion containing very finely divided particles. As a result of its fine state of sub-division, the synthetic resin can penetrate into the relatively thick paper to a similar extent as does the aminoplast resin dissolved in water and in this way, without any further measures, is responsible for the production of a rollable quality in the end product. Namely, as a result of this uniform penetration of the synthetic resin particles, there is an elasticizing of the aminoplast resin throughout the total cross section of the paper, which evokes rollability.

For good elasticization, a certain softness of the film of synthetic resin dispersion is required. The desired elasticization according to the invention is achieved with polymers whose $T_{\lambda max}$ (determined according to DIN 53 445) is at most 35° C. (As can be deduced from theoretical considerations, the $T_{\lambda max}$-value according to DIN 53445 is always above the calorimetrically-determined glass temperature, $T_g$. In the case of the acrylic resins, the difference amounts to about 10° C.).

In the interest of workability, the synthetic resin dispersion is still thermoplastically deformable and non-cross linked at the beginning of the (one-step) drying. Cross-linking (condensation) with the aminoplast resin is effected by the further heat treatment, i.e. with progressive drying.

In the manner disclosed, a rollable material is produced in an economical one-step process, which material can be used instead of a wood veneer for surfacing furniture and—in contrast to wood veneer—in a continuous process can be used not only as a surfacing material but also as an edge material.

According to the invention, this involves aqueous dispersions of polymers having a $T_{\lambda max}$ of at most 35° C., which polymers are capable of cross-linking but which do not have groups which are self-cross linking under the conditions to be employed. The monomers suitable as component elements of the synthetic resin dispersions to be used according to the present invention accordingly must be capable of reacting with added (external) reactive entities. Such components capable of external cross-linking are, for example, monomers containing hydroxyl, amino, amide, or carboxyl functions. As for the remaining components, the polymers or copolymers in question comprise, for example, vinyl esters of lower carboxylic acids, particularly having 2–4 carbon atoms such as vinyl acetate, or comprise butadiene or chlorobutadiene with styrene and/or acrylate or methacrylate esters. Other suitable dispersions, for example, comprise polymers composed of olefins, vinyl chloride, vinylidene chloride, styrene, or of mixtures of these monomers with each other or with further modifying comonomers such as vinyl ethers.

A preferred class of dispersions comprise polymers of the esters of acrylic acid and/or of methacrylic acid with $C_1$–$C_{20}$-alcohols, preferably with $C_1$–$C_8$-alcohols, wherein preferred esters of alcohols having from 1 to 4 carbon atoms form the principal component of the synthetic resin. As already disclosed, materials such as acrylic acid and methacrylic acid, acrylamide and methacrylamide come into play as modifying comonomers capable of external cross-linking. Further, compounds of the formula

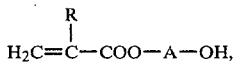

can also be added, wherein R is hydrogen or methyl and A is linear or branched alkyl having from 2 to 6 carbon atoms. The amount of the aforementioned monomers capable of external cross-linking amounts as a rule to 0.5 to 15 percent, preferably from 2 to 10 percent, by weight of the total polymer.

Preferred materials are, for example, acrylic resin dispersions which comprise methyl methacrylate, an acrylic or methacrylic acid ester of an alcohol having from 2 to 8 carbon atoms, methacrylamide, and methacrylic acid. The selection and amount of the acrylic or methacrylic acid esters of $C_2$–$C_8$ alcohols is linked with the flexibility desired in the strengthened film.

The preparation of the dispersions to be used according to the present invention is known per se. They can be prepared, for example, following the teachings of German Offenlegungsschrift No. 1,804,159. The preparatory method is suitably carried out in such a manner that a finely-divided polymer is obtained, i.e. one having a particle radius of less than 100 nanometers.

The aminoplasts to be used as the second component of the impregnating mixture to be used according to the invention for saturating raw papers or non-woven fabrics are the conventional precondensates of urea-formaldehyde and melamine-formaldehyde (cf. K. Lindner in "Tenside-Textilhilfsmittel-Waschrohstoffe", Wissenschaftliche Verlagsgesellschaft, Stuttgart 1964, pages 244–254) ["Surface Active Agents-Textile Auxiliaries-Raw Materials for Washing", Scientific Publishing Company, Stuttgart], of which various kinds are commercially available.

As substrates for impregnation, commercially-available raw decorative papers having conventional surface weights of 30–400 g/m$^2$ are employed. The impregnating mixture according to the present invention contains the aqueous synthetic resin dispersion of the aforementioned type and the water-soluble aminoplast resin in roughly comparable amounts, for example in a ratio of 10:1 to 1:10, preferably about 1:1, in each case calculated on the weight of dry material. The impregnation baths as a rule contain from 25 to 60 percent by weight of total dry solids, preferably from 35 to 45 percent by weight.

Before the application of the dispersion, the raw or untreated paper or non-woven fabric can optionally be pre-treated in a known fashion, for example in the manner described in German Auslegeschrift No. 17 71 903 by pre-impregnation with a polycationic compound or by the addition of such a material in the preparation of the untreated paper.

The application of the treating bath can follow in a known fashion, for example by passing the train of paper or non-woven fabric through a trough filled with the impregnating bath containing the dispersion and the condensation resin. The train can also be sufficiently impregnated by roller application, spraying, or coating with a doctor blade. The amount of resin to be applied can be readily adjusted by varying the concentration and/or the viscosity of the impregnating bath. This amount depends on the requirements of the ultimate field of use and the desired final quality and is generally between 20 and 150 percent by weight, preferably between 30 and 80 percent by weight, of the substrate material. Drying can follow directly after treatment with the impregnating bath.

As already mentioned, the acrylic resin dispersions can be prepared according to known methods, for example by an emulsion addition process.

In this process, for example, a portion of the monomers is emulsified in an aqueous medium and the remaining portion of the monomers is added in the form of an aqueous emulsion to the reaction batch as polymerization proceeds. As emulsifiers, the conventional anionic, cationic, or nonionic surface active agents can be employed. In case polycations have been applied to the paper prior to impregnation according to German Auslegeschrift No. 17 71 903, it is advantageous to work with anionic dispersions. As anionic surface active agents, the sulfuric acid half-esters of higher alcohols are available, for example, As initiators, commercially-available water-soluble per-compounds can be employed, for example, materials such as hydrogen peroxide and/or alkali metal or ammonium persulfates, optionally in combination with reducing components (redox systems). The reaction temperatures vary between room temperature and the boiling point of the system depending on the initiator and the monomers.

According to a particularly advantageous embodiment, impregnation with the impregnation bath can take place using an impregnation arrangement in which a train of paper or fibrous material passing there through is first pre-impregnated by roller application. In order to de-aerate the pre-impregnated train, the latter is then led over a so-called "breathing section" (in which it remains for several seconds). After air has been removed from the train in this manner, a full impregnation in the immersion bath can be carried out. Subsequently, excess bath is squeezed out between rolls or wiped off with blades and in this way the desired amount of resin to be applied is attained. In special cases, in which a particularly good total impregnation or impregnation on one side only is sought for, a process according to German Offenlegungsschrift No. 25 50 980 which employs a vacuum arrangement is available.

From the immersion apparatus, the impregnated train is then led through a dryer having one or preferably several drying zones, without coming into contact with other objects. The rate of transport of the train depends on the length of the drying zone or zones as well as on the drying temperature. In general, the drying temperature is between 60° C. and 200° C. When several drying zones are present, suitably zones having step-wise differing temperatures are employed, beginning with the lowest temperature. As drying arrangements which do not involve contact, jet-suspension dryers are advantageously employed. Subsequent to, or interposed in, the drying train, an arrangement can be present for the application of a coating or finish. Further, a suitable sealable adhesive can be applied with an appropriate arrangement, optionally in a combined preparatory method.

The completed train can subsequenty directly be cut to the desired shape or can be rolled up into rolls.

The webs (veneers, coating papers) prepared according to the invention are characterized by an outstanding quality. Particularly desirable is their closed smooth surface, their high resistance to splitting and tear propagation, a high resistance to light and ageing, resistance to aggressive materials, heat resistance, easy care, and a good ability to adhere. In case a matte or half-matte surface is desired, suitable matting agents can be incorporated into the impregnation bath without difficulty.

A better understanding of the present invention and of its many advantages will be had by referring to the following specific Examples, given by way of illustration.

EXAMPLE 1

310 g of water, 0.6 g of Na-dodecyl sulfate, 9 g of ethyl acrylate, 4.8 g of methyl methacrylate, 0.3 g of methacrylic acid, and 0.9 g of methacrylamide are emulsified in a Wittig vessel (2 liters) equipped with a stirrer, reflux condenser, interior thermometer, and dropping funnel. After heating the contents to 80° C. and holding them there, 0.4 g of potassium persulfate dissolved in 10 g of water is added and four minutes later the addition is begun of a previously-prepared emulsion of 480 g of water, 7.3 g of Na-dodecyl sulfate, 1.2 g of potassium persulfate, 471 g of ethyl acrylate, 251.2 g of methyl methacrylate, 15.7 g of methacrylic acid, and 47.1 g of methacrylamide. After addition (addition time=4 hours), the temperature is maintained for an additional hour at 80° C. and then reduced to 25° C. Thereafter, a 35 percent aqueous solution of a condensation product of isononylphenol and ethylene oxide (mol ratio=1:50) is added over a period of 45 minutes and a slight amount of coagulate which forms is then filtered out using a fine sieve. A dispersion having an average particle radius of 70 nm is obtained. The $T_{\lambda max}$ is determined to be 33° C.

EXAMPLE 2

Example 1 is repeated except that, instead of the monomers there mentioned, 13.2 g of ethyl acrylate and 1.2 g of 2-hydroxyethyl acrylate are present in the reaction vessel initially and 722.2 g of ethyl acrylate and 62.8 g of 2-hydroxyethyl acrylate are added thereto. The remaining components and the procedure remain unchanged. Dispersions having an average particle radius of 82 nm are obtained. A value of −10° C. is determined for $T_{\lambda max}$.

EXAMPLE 3

440 g of water, 11.2 g of Na-dodecyl sulfate, and 0.56 g of potassium persulfate are heated to 80° C. in a Wittig vessel. At this temperature, an emulsion of 672 g of water, 1.68 g of Na-dodecyl sulfate, 1.68 g of potassium persulfate, 240 g of butyl acrylate, 211.4 g of methyl methacrylate, 4.8 g of methacrylic acid, and 24 g of methacrylamide is then added over a period of four hours. The mixture is held at this temperature for an additional hour, then cooled and filtered using a fine sieve. Dispersions having an average particle radius of 65 nm are obtained. $T_{\lambda max}$=25° C.

EXAMPLE 4

An absorbent raw decorative paper having a surface weight of 80 g/m$^2$ is impregnated in an impregnating tub with an impregnation bath comprising 500 g of the dispersion described in Example 1, 500 g of a urea-formaldehyde resin solution (commercially available under the tradename "Kaurit 420", 50 percent solids content) 250 g of water, 2 g of ammonium chloride, and 2 g of a wetting agent (weakly-sulfated rapeseed oil).

Impregnation takes place by touching the untreated paper to the bath surface in order to wet it and then subsequently immersing it for a complete impregnation. Subsequently, the impregnated paper is squeezed off between rubber rolls and dried in a drying oven for three minutes at 140° C.

A medium-hard flexible web is obtained having a final weight of 124 g/m$^2$, a residual moisture content of 4 percent, and an applied resin content of 42.5 percent by weight of the untreated paper.

EXAMPLE 5

Example 4 is followed except that the impregnation bath comprises 700 g of the dispersion of Example 2, 300 g of urea-formaldehyde resin solution (50 percent solids content), 250 g of water, 1.5 g of ammonium chloride, and 2 g of the wetting agent described in Example 4.

The web so prepared has a highly-flexible character ("Sheath film"), the amount of applied resin is 41 percent, the final weight is 112.8 g/m$^2$, and the residual moisture is 5 percent.

EXAMPLE 6

An absorbent raw paper having a surface weight of 200 g/m$^2$ is impregnated as described above in an impregnation bath which comprises 1000 g of the dispersion described in Example 3, 600 g of urea-formaldehyde resin solution (50 percent solids content), 1.5 g of ammonium chloride, and 3 g of a wetting agent, and is then further treated as described above.

The final product is a film which finds use as an edge band in the furniture and particle board industry. It has an applied resin content of 38 percent, a residual moisture of 5 percent, and a final weight of 276 g/m$^2$.

What is claimed is:

1. A method for making a synthetic veneer, which method comprises impregnating a fibrous web structure with an agent consisting essentially of an aqueous dispersion of a finely divided synthetic resin free of self-crosslinking groups but comprising a plurality of groups capable of external crosslinking reactions with an aminoplast resin, said dispersion further having a water-soluble aminoplast resin dissolved therein, and then drying the impregnated web structure at a temperature from 60° C. to 200° C. out of contact with other objects in a single drying step directly to produce said synthetic veneer, said synthetic resin being thermoplastically deformable and in a non-crosslinked condition at the beginning of the drying step but entering into crosslinking reactions with said aminoplast resin during drying.

2. A method as in claim 1 wherein said synthetic resin comprises hydroxy, amido, or carboxy groups as the groups capable of external crosslinking and, after evaporation of water from said aqueous dispersion, forms a film having a $T_{\lambda max}$-value of at most 35° C.

3. A method as in claim 1 wherein said fibrous web structure is a raw paper or non-woven fabric.

4. A method as in claim 1 wherein said synthetic resin is a copolymer consisting essentially of at least one member selected from the group consisting of acrylic acid esters and methacrylic acid esters and at least one member selected from the group consisting of acrylic acid, methacrylic acid, acrylamide, methacrylamide, and compounds of the formula $$H_2C{=}\overset{\overset{\displaystyle R}{|}}{C}{-}COO{-}A{-}OH,$$

wherein R is hydrogen or methyl and A is linear or branched alkylene having 2 to 6 carbon atoms.

5. A method as in claim 4 wherein said resin has a content of monomers capable of external crosslinking which is from 0.5 to 15 percent by weight of the polymer.

6. A method as in claim 4 wherein said resin has a content of monomers capable of external crosslinking which is from 2 to 10 percent by weight of the polymer.

7. A method as in claim 4 wherein said synthetic resin is a copolymer of methyl methacrylate, methacrylamide, methacrylic acid, and a member selected from the group consisting of the acrylic acid esters and methacrylic acid esters of $C_2$–$C_8$ alcohols.

8. A method as in claim 1 wherein the radius of the particles in the synthetic resin dispersion is less than 100 nanometers.

9. A method as in claim 1 wherein the impregnated web is dried by heating at a temperature between 80° C. and 180° C.

10. A method as in claim 1 wherein the impregnated web is dried by heating at a temperature between 100° C. and 150° C.

11. A method as in claim 1 wherein said aminoplast resin is a urea-formaldehyde resin.

12. A synthetic veneer made by the method of claim 1.

* * * * *